US005265856A

United States Patent [19]

Walker

[11] Patent Number: 5,265,856

[45] Date of Patent: Nov. 30, 1993

[54] SHEET FEEDING AND FLATTENING APPARATUS

[75] Inventor: John M. Walker, Caldecote Beds, England

[73] Assignee: Xerox Corporation, Stamford, Conn.

[21] Appl. No.: 68,043

[22] Filed: May 28, 1993

[30] Foreign Application Priority Data

Jul. 17, 1992 [GB] United Kingdom ..... 9215280

[51] Int. Cl.[5] ..... B65H 5/22

[52] U.S. Cl. ..... 271/3.1; 493/409; 493/406; 271/94; 271/8.1; 271/264; 271/35

[58] Field of Search ..... 271/3.1, 35, 8.1, 92, 271/94, 18, 264, 188, 161, 196, 197; 162/270; 493/409, 406, 395, 419, 437

[56] References Cited

U.S. PATENT DOCUMENTS

| | | | |
|---|---|---|---|
| 4,071,233 | 1/1978 | Morton et al. | 271/264 |
| 4,462,586 | 7/1984 | Browne et al. | 271/94 |
| 4,614,334 | 9/1986 | Henmi et al. | 271/264 |
| 5,000,438 | 3/1991 | Sardano et al. | 271/264 |
| 5,147,274 | 9/1992 | Mandel | 493/409 |
| 5,152,515 | 10/1992 | Acquaviva | 271/3.1 |

FOREIGN PATENT DOCUMENTS

| | | |
|---|---|---|
| 1511184 | 5/1978 | United Kingdom . |
| 2017054 | 10/1979 | United Kingdom . |
| 2013187 | 2/1983 | United Kingdom . |

*Primary Examiner*—H. Grant Skaggs

[57] ABSTRACT

A sheet feeder, such as recirculating document handler for a copying machine, is provided with movable sheet flattening guide arms (31) for flattening out upturned sheet corner dog-ears in the leading edge of a document sheet (13A) as each sheet is fed from the stacking tray (12) of the document handler. The guide arms (31) are located adjacent to and preferably behind the front wall (29) of the tray and, as a document is fed beneath the wall, they automatically move out transversely along the leading edge of the document to flatten it, particularly at the corners (13B), thereby enabling dog-eared or curled documents to be fed without becoming jammed.

14 Claims, 2 Drawing Sheets

SHEET FEEDING AND FLATTENING APPARATUS

The present invention relates to improved sheet feeding, and, in particular, to improvements in apparatus in which paper or other such flimsy sheets with curled or dog-eared edges are fed one at a time from a sheet supporting surface. The disclosed system is particularly, but not exclusively, applicable to document handling apparatus for use in copying machines.

Recirculating document handlers for copying machines have a tray in which a stack of documents to be copied is placed. Documents are fed one at a time, from the tray, to the platen of the machine where they are copied. After copying, documents are returned to the tray of the document handler from where they can be recirculated again if more than one copy is required. Generally, a document handler can only be reliably used if the documents to be copied are in relatively good condition and without folds or a large amount of curl: otherwise, the documents should be placed individually on the platen by the user, which can be very time consuming. If documents which are not in good condition are placed in the document handler of a copying machine, there is a risk that they may become jammed, and even possibly damaged, as a result. That is particularly true for sheets which have folded-up corners, known as "dog-ears", on their leading edge corners.

The need to copy documents individually unless they are completely flat can be tiresome to a user, particularly when an increasing number of original documents are produced in laser or color printers which may produce a degree of sheet curl.

In an automatic document feeder it is possible to provide an arm in the document tray to attempt to hold curled documents flat and so enable them to be fed from the tray. However, dog-eared documents continue to cause problems even when a document tray is provided with such a hold-down arm. Moreover, while a hold-down arm may be a satisfactory solution for some curled documents in an automatic document feeder (in which documents are fed only once from the document tray), it cannot be readily used in a recirculating document handler, where such an arm would interfere with restacking documents.

In a recirculating document handler, rigid sheet guides are often used to define the document path from the tray of the document handler to the platen of the copying machine. By appropriate shaping of the entrance to those guides, it is possible to increase the tolerance of the document handler to documents that are in a less than perfect condition. However, many documents still become jammed.

Art noted to date, especially by way of further background on "dog ear" document feeding problems, includes Xerox Corporation U.S. Pat. No. 5,147,274 issued Sep. 15, 1992 to Barry P. Mandel; U.S. Pat. No. 5,000,438 issued Mar. 19, 1991 to Peter A. Sardano, et al.; UK patent Application GB 2 017 054A published Oct. 3, 1979; GB 1 511 184A published May 17, 1978 and GB 2 103 187A published Feb. 16, 1983.

The disclosed system is directed towards enabling documents which are in a less than perfect condition to be fed from the sheet-supporting surface of a sheet feeding apparatus (more especially, the tray of a recirculating document handler) without either being damaged or becoming jammed.

The disclosed system provides, in sheet feeding apparatus comprising a sheet-supporting surface and means for feeding sheets one at a time from a sheet-supporting surface, apparatus including at least one guide member desirably movable relative to the leading edge of the sheet to flatten the leading edge as it leaves the sheet-supporting surface.

The system disclosed herein is desirably compact and simple and can fit into the limited space of even existing document handlers without interfering with other sheet feeding functions.

Disclosed herein is, in a sheet feeding apparatus comprising a sheet-supporting surface and a sheet feeder for feeding sheets one at a time from the sheet-supporting surface in a sheet feeding path, the improvement comprising at least one movable sheet flattening member, and a drive system for automatically moving said sheet flattening member transversely of the sheet feeding path to at least partially flatten the leading edge of a sheet fed from the sheet-supporting surface, and so as to fold down curls or dog-ears on the leading edge of a fed sheet from interfering with sheet feeding.

As to specific hardware components of the subject apparatus, or alternatives therefor, it will be appreciated that, as is normally the case, some such specific hardware components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background.

Various of the above-mentioned and further features and advantages will be apparent from the specific apparatus and its operation described in the examples below, as well as the claims. Thus, the present invention will be better understood from this description of this exemplary embodiment, including the drawing figures (approximately to scale) wherein:

Figure 1:
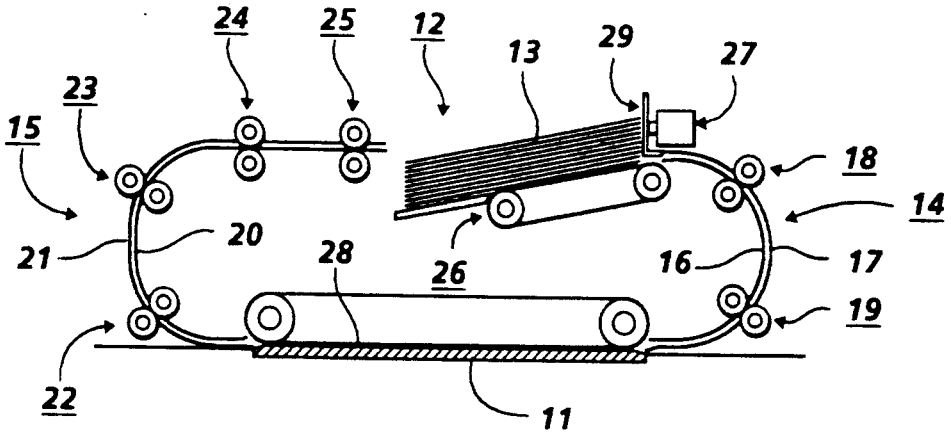
FIG. 1 is a schematic view of a recirculating document handler of a copying machine.

FIG. 1 shows a recirculating document handler 10 mounted over the platen 11 of a xerographic copying machine. The remainder of the copying machine is not shown and need not be described here since details of the machine are not required for an understanding of the present invention. The machine may be any known copying machine, for example the Xerox 5046 copier.

The document handler 10 comprises a tray 12 in which a stack 13 of documents is placed for copying. Documents are fed one at a time from the bottom of the stack and around a curved path 14 to the platen 11, being returned around a curved path 15 to the top of the stack 13. The curved path 14 is defined by curved inner and outer guides 16, 17 between which documents are fed by nip roller pairs 18, 19. Likewise, the curved path 15 is defined by curved inner and outer guides 20, 21 between which documents are fed by nip roller pairs 22, 23. Further feed roller pairs 24, 25 are provided at the output end of the guides 20, 21 to feed documents back onto the stack 13 in the tray 12.

A vacuum belt feeder 26 is located beneath the tray 12 and, in conjunction with an air knife 27 located at the front of the tray, functions to separate the bottom document from the stack 13 and feed it between the curved guides 16, 17. Vacuum belt feeders and air knives are well known and need not be described in detail. Documents are placed face-up in the tray 12 of the document handler so that each is fed face down onto the platen 11 of the copying machine. A document transport belt 28 carries each document across the platen into a registration position, where it is exposed by the imaging system of the copier before being fed off the platen and returned, by way of the curved guides 20, 21, to the tray 12 where it is deposited in its original orientation (i.e. face-up).

Figure 2:
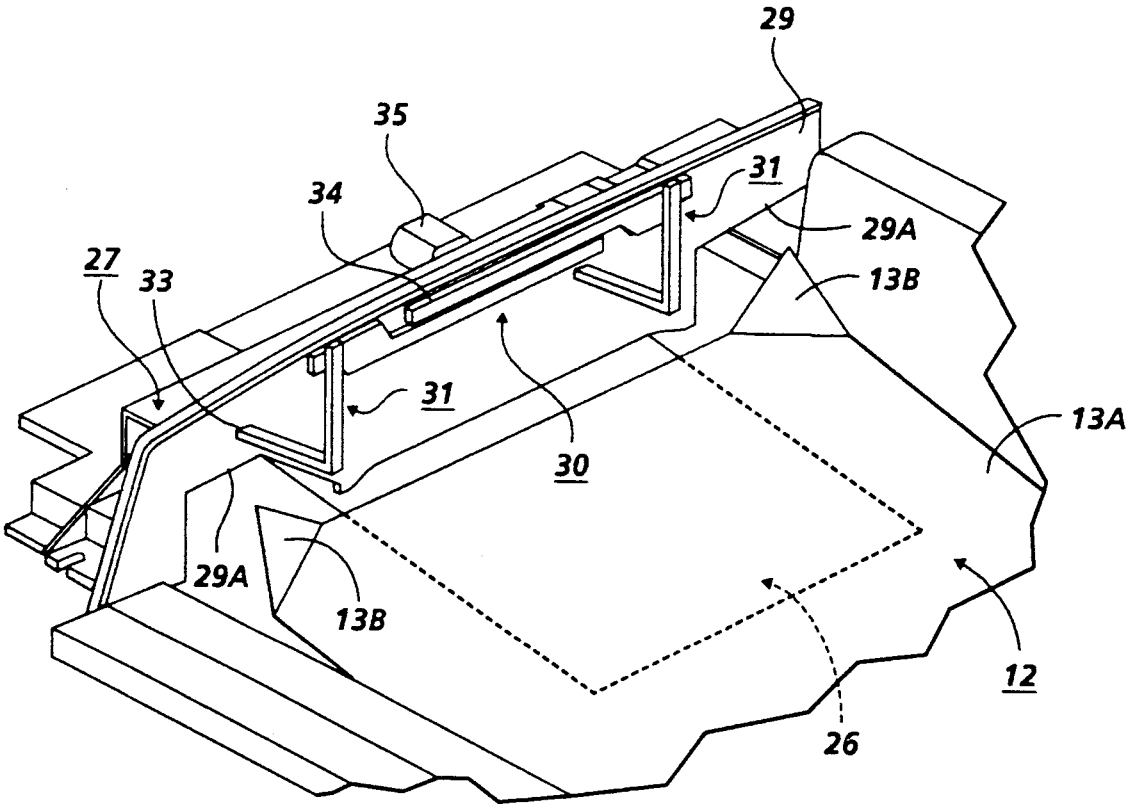
FIG. 2 is a perspective view showing certain components of the document handler.

The front end of the document handler 10 is shown in greater detail (and from the opposite side) in FIG. 2. For clarity, certain parts of the document handler are shown in outline only. The air knife 27 at the front of the tray 12 is conventional and comprises a series of nozzles (not shown) which are arranged to direct jets of air at the bottom of the stack 13 of documents in the tray. The jets of air separate and lift the documents, enabling the bottom document to be pulled down onto the vacuum belt feeder 26 and carried forwards out of the tray. In FIG. 2, the stack 13 has been omitted for clarity and only the bottom document 13A is shown as it is being carried forward on the vacuum belt feeder 26 towards the front wall 29 of the tray 12. The wall 29 is shown in outline only, to enable a guide arm mechanism 30 (described below), located behind the wall, to be seen. The vacuum belt feeder 26 carries the document 13A underneath the front wall 29 of the tray and into the entrance to the path between the curved guides 16, 17.

As can be seen from FIG. 2, both of the front corners 13B of the document 13A are dog-eared. To enable the document 13A to be fed underneath the front wall 29 of the tray 12 without becoming jammed, the wall 29 is cut away at 29A on each side of the belt feeder 26 to accommodate the dog-eared corners 13B. Typically, the height of the cut-away regions 29A is 40 mm above the bottom of the tray.

The guide arm mechanism 30 is provided behind the wall 29 to flatten the document 13A sufficiently to enable it to be fed between the curved guides 16, 17. The mechanism 30 comprises a pair of guide arms 31 each of which has a vertical portion 32 located adjacent the wall 29 and a horizontal portion 33 which extends away from the wall adjacent the document path from the tray 12. At its upper end, each vertical portion 32 is mounted on a respective drive rack 34 which extends inwardly, generally parallel to the top of the wall 29, towards the center line of the tray 12 where it is in operative engagement with a pinion (not visible in FIG. 2) driven by a reversible motor 35. The drive racks 34 are so arranged that the pinion engages the top edge of one rack and the bottom edge of the other, whereby the motor 35 moves the guide arms 31 simultaneously but in opposite directions. In other words, the guide arms 31 both move outwards together or inwards together, depending on the direction of operation of the motor 35. Alternatively, a solenoid or other automatic drive could be used to reciprocally move, or pivot, these sheet-flattening arms or fingers 31. The solenoid or the like could alternatively be actuated by the usual sheet lead edge sensor in the sheet path entrance. [See, e.g., the cited art.] If desired, solenoid stroke movement could be multiplied by lever or compound pully arrangement in a known manner.

Figure 3A:
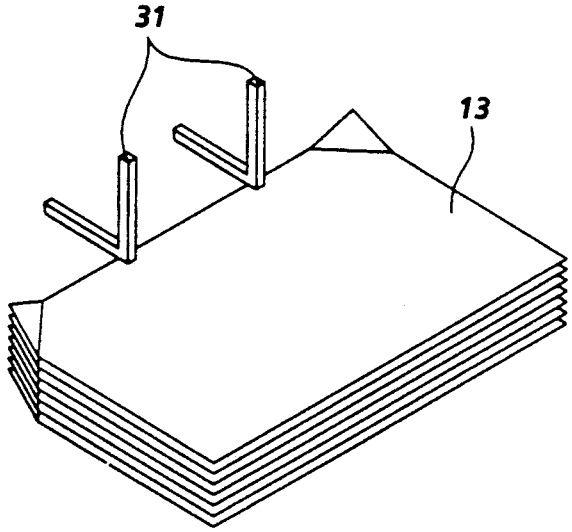
FIGS. 3A to 3D illustrate, schematically, the operation of a component of the document handler.
Figure 3B:
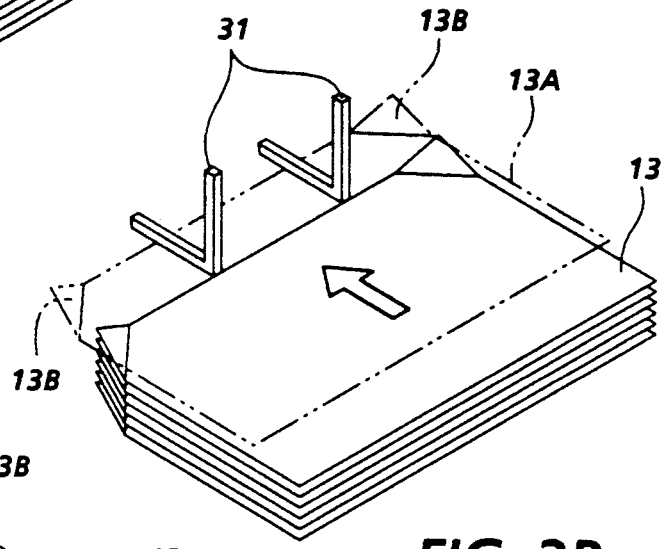
Figure 3C:
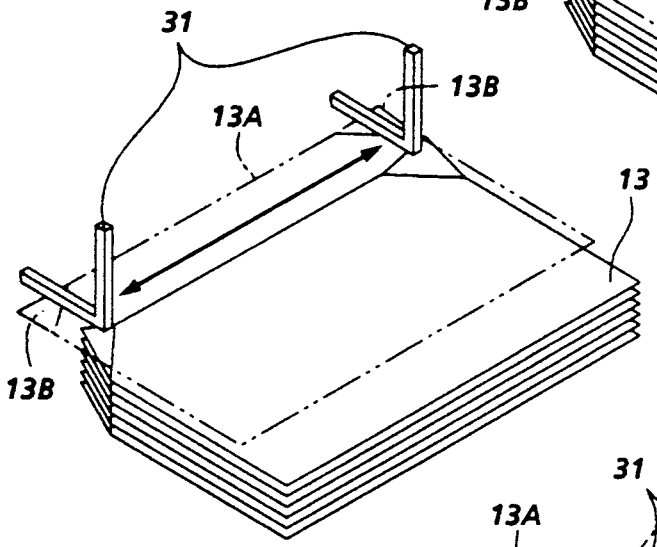

Before the document 13A is fed from the tray 12, the guide arms 31 are parked near the center line of the stack 13, as shown in FIG. 3A. As the bottom document 13A is moved forwards by the vacuum belt feeder 26, the dog-eared corners 13B move through the cut-away regions 29A of the tray wall 29 (not shown in FIGS. 3A to 3D) while the central portion of the leading edge of the document 13A moves under the wall 29 in the normal way. Once it has passed under the wall 29, the central portion of the leading edge of the document 13A begins to move underneath the guide arms 31, as shown in FIG. 3B, whereupon the motor 35 is operated to move the guide arms 31 outwards to a position just inside the corners 13B of the document, as shown in FIG. 3C. Operation of the motor 35 commences a predetermined time interval, typically about 15 ms, after the vacuum belt feeder 26 has been switched on: that time interval is sufficient to allow a 15 to 20 mm length of the document to be fed under the guide arms 31. The outward movement of the guide arms flattens the dog-ears and the arms then remain in the outermost position to hold the corners 13B of the document at an acceptable height to ensure that the document will pass easily into the space between the curved guides 16, 17 (FIG. 1).

To assist in guiding the document 13A into the space between the curved guides 16, 17, the latter may be provided with a tapered entrance portion or throat for receiving the lead edge of the document after it has been flattened by the guide arms 31. The mouth of the entrance portion may, for example, have a height which corresponds to that of the cut-away regions 29A of the tray wall 29, after which the height of the entrance portion tapers down to the spacing between the guides 16, 17 (typically, 3 mm). Once the lead edge of the document 13A has entered the space between the guides, the dog-ears 13B are held flat by the guides themselves.

Figure 3D:
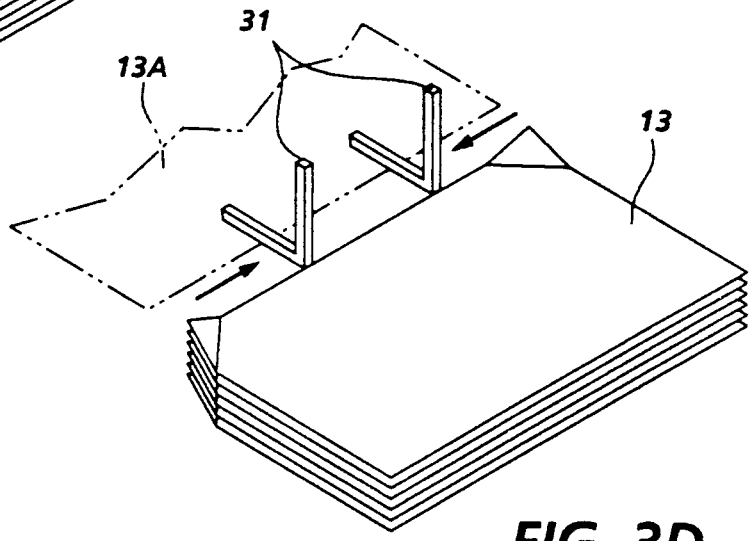

After the dog-eared corners 13B of the document 13A have passed underneath the guide arms 31, the motor 35 is operated again but in the reverse direction to move the guide arms back inwards to the parked position, as shown in FIG. 3D, ready for the next document to be fed from the bottom of the stack 13.

To accommodate documents which are not exactly of the size for which the document handler 10 is intended, the horizontal portion 33 of the bottom edge guide arm 31 may be enlarged so that the arm will flatten the corners of a range of documents despite the fact that the distance traveled by the arm is fixed. Also, they may be angled (toed out) at approximate typical dog ear fold-over angles, if desired.

It will be appreciated that, although the document 13A shown in FIGS. 2 and 3 is dog-eared at both of its leading corners 13B, the guide mechanism 30 will be equally effective on a document that is dog-eared at one corner only and on a document which has turned-up corners because it is curled. However, for documents which are turned-up at one corner only, a single guide arm 31 (moving out to the turned-up corner) would be sufficient. For simplicity, the guide mechanism 30 shown in the drawings is arranged to operate each time a document is fed from the tray 12 of the document handler 10, even if the document is already flat. However, it would be possible for the guide mechanism to operate only when selected by the user of the copying machine.

Although the document handler 10 described above uses a vacuum belt feeder 26 to feed documents from the tray 12, that is not an essential feature of the invention and any suitable mechanism, for example a friction retard feeder, could be used to feed documents into the guide path. Moreover, the guide mechanism 30 is not restricted to use in a recirculating document handler and could be used in any location where curled or dog-eared sheets might be fed from a support surface.

While the embodiment disclosed herein is preferred, it will be appreciated from this teaching that various alternatives, modifications, variations or improvements therein may be made by those skilled in the art, which are intended to be encompassed by the following claims:

I claim:

1. In a sheet feeding apparatus comprising a sheet-supporting surface and a sheet feeder for feeding sheets one at a time from the sheet-supporting surface in a sheet feeding path, the improvement comprising at least one movable sheet flattening member, and a drive system for automatically moving said sheet flattening member transversely of the sheet feeding path to at least partially flatten the leading edge of a sheet fed from the sheet-supporting surface, and so as to fold down curls or dog-ears on the leading edge of a fed sheet from interfering with sheet feeding.

2. The sheet feeding apparatus of claim 1, in which said movable sheet flattening member is movable by said drive system from an intermediate area of the leading edge of the sheet outwards towards a corner of the sheet.

3. The sheet feeding apparatus of claim 2, comprising a pair of said sheet flattening members, each of which is movable from said intermediate area of the leading edge of the sheet outwards towards respective corners of the sheet after said sheet feeding is indicated.

4. The sheet feeding apparatus of claim 3, wherein said drive system also automatically returns said sheet flattening members from the corners of the sheet back to their initial said intermediate position.

5. The sheet feeding apparatus of claim 3, in which said sheet flattening member comprises a guide arm beneath which the sheet is fed as it is fed from said sheet-supporting surface by said sheet feeder, said sheet flattening member being mounted adjacent said sheet feeding path end of said sheet supporting surface.

6. The sheet feeding apparatus of claim 3, wherein said drive system moves said sheet flattening arms simultaneously in opposite directions.

7. The sheet feeding apparatus of claim 6, in which said drive member comprises each sheet flattening arm being mounted on a rack member, and the rack members being in operative engagement with a rotatable pinion.

8. The sheet feeding apparatus of claim 7, wherein said drive member further includes a motor for rotating said pinion, said motor being reversible whereby operation of said motor in one direction moves said guide arms outwards towards the corners of the sheet and operation of said motor in the other direction returns said guide arms to their initial position.

9. The sheet feeding apparatus of claim 8, in which said motor is automatically activated at a predetermined time interval after the activation of said sheet feeder.

10. The sheet feeding apparatus of claim 1 in which said sheet-supporting surface is a sheet stacking tray for receiving a stack of sheets, and said sheet feeder is operable to feed the bottom sheet from a stack of sheet thereon.

11. The sheet feeding apparatus of claim 10, in which said sheet stacking tray has a front wall beneath which the bottom sheet is fed, with portions of said wall being shaped to permit the initial passage of up-turned corners of the sheet being fed.

12. The sheet feeding apparatus of claim 10 in which said sheet feeder comprises a vacuum belt feeder in the bottom of said sheet stacking tray.

13. The sheet feeding apparatus of claim 1, wherein said sheet feeding apparatus is a recirculating document handler for a copying machine with a return path feeder for returning sheets to said sheet-supporting surface for restacking thereon.

14. The sheet feeding apparatus of claim 1, wherein there are two said movable sheet flattening members, both movable by said drive system from an immediate area of the leading edge of the sheet outwards towards respective corners of the sheet, and wherein said drive system also automatically returns said sheet flattening members from the corners of the sheet back to their initial said intermediate position, and wherein each said sheet flattening member comprises a downstream extending guide arm beneath which the sheet is fed as it is fed from said sheet-supporting surface by said sheet feeder, said sheet flattening members being mounted adjacent said sheet feeding path end of said sheet supporting surface.

* * * * *